US008075736B2

(12) United States Patent
Nakazawa et al.

(10) Patent No.: US 8,075,736 B2
(45) Date of Patent: Dec. 13, 2011

(54) DEFLECTION COMPENSATION ROLL

(75) Inventors: Takeo Nakazawa, Tokyo (JP); Osamu Fujimura, Tokyo (JP); Junichi Ito, Chiba (JP); Jun Murakawa, Chiba (JP)

(73) Assignee: Voith Patent GmbH, Heidenheim (DE)

( * ) Notice: Subject to any disclaimer, the term of this patent is extended or adjusted under 35 U.S.C. 154(b) by 1191 days.

(21) Appl. No.: 11/571,489

(22) PCT Filed: Jun. 28, 2005

(86) PCT No.: PCT/EP2005/053016

§ 371 (c)(1),
(2), (4) Date: Mar. 8, 2007

(87) PCT Pub. No.: WO2006/003140

PCT Pub. Date: Jan. 12, 2006

(65) Prior Publication Data

US 2008/0023167 A1 Jan. 31, 2008

(30) Foreign Application Priority Data

Jun. 30, 2004 (JP) ..... 2004-192461

(51) Int. Cl.
*D21F 1/00* (2006.01)

(52) U.S. Cl. ..... 162/336

(58) Field of Classification Search ..... 162/336, 162/263, 272, 346

See application file for complete search history.

(56) References Cited

U.S. PATENT DOCUMENTS

| | | | | |
|---|---|---|---|---|
| 4,687,548 | A | 8/1987 | Ilmoniemi et al. | |
| 5,470,439 | A | 11/1995 | Makino et al. | |
| 5,833,808 | A | 11/1998 | Shand et al. | |
| 6,117,272 | A * | 9/2000 | Heinzmann | 162/216 |
| 6,294,051 | B1 * | 9/2001 | Urquhart et al. | 162/212 |

FOREIGN PATENT DOCUMENTS

| | | |
|---|---|---|
| DE | 35 38 466 C2 | 5/1986 |
| EP | 0595325 | 4/1998 |
| JP | S62-162096 | 7/1987 |
| JP | S62-191592 | 7/1987 |
| JP | H06-192989 | 7/1994 |
| JP | H11-1884 | 1/1999 |

* cited by examiner

*Primary Examiner* — Mark Halpern
(74) *Attorney, Agent, or Firm* — Greenblum & Bernstein, P.L.C.

(57) ABSTRACT

Headbox for a paper machine which discharges paper raw material onto a wire as a raw material jet from a slice which is supplied with the paper raw material. The headbox includes an orientation correcting arrangement for correcting a pulp fiber orientation by supplying the paper raw material as a correction flow to a single location in either a central portion of the slice or a plurality of locations other than end portions thereof. The paper raw material is one of extracted from a taper header in which paper raw material for a main flow is stored and extracted from a correction-only taper header in which paper raw material for correcting the pulp fiber orientation is stored. This abstract is not intended to define the invention disclosed in the specification, nor intended to limit the scope of the invention in any way.

26 Claims, 11 Drawing Sheets

(a)

(b)

PRIOR ART

PRIOR ART

PRIOR ART

PRIOR ART

DEFLECTION COMPENSATION ROLL

CROSS-REFERENCE TO RELATED APPLICATIONS

The present application is a U.S. National Stage of International Patent Application No. PCT/EP2005/053016 filed Jun. 28, 2005 which published as WO 2006/003140 on Jan. 12, 2006, and claims priority of Japanese Patent Application No. 2004-192461 filed Jun. 30, 2004.

BACKGROUND OF THE INVENTION

1. Field of the Invention

The present invention relates to a headbox in a paper machine which discharges paper raw material in a widened slit-form.

2. Discussion of Background Information

Paper machines for making paper include a non-concentration controlling type paper machine in which paper is manufactured by setting the fiber concentration of the pulp raw material in advance, and a concentration controlling type paper machine in which paper is manufactured by mixing high concentration pulp raw material and dilution water to control the fiber concentration.

In a non-concentration controlling type paper machine, as shown in FIG. 10(*a*), which is a schematic top view of a headbox 101, and FIG. 10(*b*), which is a schematic view seen from the direction of an arrow A, illustrating the interior of the headbox 101 of FIG. 10(*a*), pulp raw material is stored in a taper header 102 with the fiber concentration thereof set in advance.

The pulp raw material stored in the taper header 102 is supplied to a slice 105 via a chamber 103 and a turbulence generator 104, and then discharged from the slice 105 as a raw material jet "gj" onto a wire (not shown).

On the other hand, in a concentration controlling type paper machine, as shown in FIG. 11(*a*), which is a schematic top view of a headbox 201, and FIG. 11(*b*), which is a schematic view seen from the direction of an arrow B, illustrating the interior of the headbox 201 of FIG. 11(*a*), high concentration pulp raw material is stored in a high concentration taper header 202*a*, and dilution water is stored in a dilution water taper header 202*b*.

The high concentration pulp raw material in the high concentration taper header 202*a* and the dilution water in the dilution water taper header 202*b* are mixed and conveyed to a mixing chamber 203, whereupon the mixture is supplied to a slice 205 via a turbulence generator 204 and discharged from the slice 205 as a raw material jet "gj" onto a wire (not shown).

The pulp raw material placed on the wire in this manner is drained of moisture while being conveyed in a subsequent process, and thus formed into the end product paper.

Incidentally, ever-higher quality is being demanded for paper recently, and a particularly high standard is being demanded for the orientation of the pulp fibers of the paper, or in other words the fiber orientation, not only in western paper, but also in paperboard.

In the case of paper produced in a paper machine, for example, an average angle of no more than plus/minus 3 is typically demanded for the flow direction of the raw material jet "gj" of pulp fibers "ps" of the paper shown in FIG. 9(*a*).

Hence, in a conventional first regulation method for improving fiber orientation, as shown in FIG. 10(*a*), a top lip plate 107 of the headbox 101 is regulated to a Cross/Direction direction (to be referred to as C/D direction hereinafter) (the direction of the arrow "a1") in the case of a non-concentration controlling type paper machine, and likewise in the case of a concentration controlling type paper machine, as shown in FIG. 11(*a*), a top lip plate 207 of the headbox 201 is regulated to the C/D direction (the direction of the arrow a2), and thus the direction of the raw material jet "gj" is regulated.

In a second regulation method for a non-concentration controlling type paper machine, as shown in FIG. 10, pipes 104*a* for correcting the fiber orientation are disposed at both ends of the turbulence generator 104, and thus the direction of the raw material jet "gj" in the C/D direction is corrected.

Likewise in a concentration controlling type paper machine, as shown in FIG. 11, pipes 204*a* for correcting the fiber orientation are disposed at both ends of the turbulence generator 204, and hence the velocity of the raw material jet "gj" is increased or decreased, thus correcting the direction of the raw material jet "gj" in the C/D direction.

The following are disclosed as prior art documents relating to the present application.

[Patent Document 1]
Japanese Unexamined Patent Application Publication S62-162096

[Patent Document 2]
Japanese Unexamined Patent Application Publication S62-191592

[Patent Document 3]
Japanese Unexamined Patent Application Publication H06-192989

[Patent Document 4]
Japanese Unexamined Patent Application Publication H11-1884

SUMMARY OF THE INVENTION

Problems Solved by the Invention

In the first regulation method for improving the fiber orientation property, although the direction of the raw material jet "gj" is corrected by altering the shape of the top lip plates 107, 207, the extent of the impact of a single action is too great due to the structure of the top lip plates 107, 207, and hence there are limitations on localized correction of the fiber orientation.

Meanwhile, in the second regulation method, only the two end portions of the slice are corrected, which is effective when the slice width is between three and four meters, but when the slice width is great, for example up to approximately eight meters, it becomes difficult to have an effect over the entire width.

In addition, it is often impossible to respond to cases in which the fiber orientation needs to be corrected toward the centre of the slice.

The present invention has been designed in consideration of the circumstances described above, and provides a headbox for a paper machine in which correction of the fiber orientation of paper is possible over the entire width of the C/D direction, regardless of the slice width, and in which the fiber orientation in the direction of paper thickness can be corrected over the entire thickness of the paper.

Ways of Solving the Problems

A headbox for a paper machine according to the present invention discharges paper raw material onto a wire as a raw material jet from a slice which is supplied with the paper raw material, and comprises an orientation correcting arrangement for correcting the pulp fiber orientation by supplying the paper raw material, which is extracted from a taper header in which paper raw material for a main flow is stored or from a correction-only taper header in which paper raw material for correcting the pulp fiber orientation is stored, as a correction flow to a single location in a central portion of the slice or a plurality of locations on the slice via at least one flow control valve.

A headbox for a paper machine according to the present invention is also provided which discharges paper raw material onto a wire as a raw material jet from a slice which is supplied with the paper raw material, and further comprises an orientation correcting arrangement for correcting the pulp fiber orientation by supplying the paper raw material, which is extracted from a taper header in which paper raw material for a main flow is stored or from a correction-only taper header in which paper raw material for correcting the pulp fiber orientation is stored, as a correction flow to a plurality of locations on the slice, other than the two end portions thereof, via at least one flow control valve.

A headbox for a paper machine according to the present invention is also provided which pertains to the headbox for a paper machine and further comprises an orientation correcting arrangement for correcting the pulp fiber orientation by supplying paper raw material extracted from the taper header or correction-only taper header as a correction flow to the two end portions of the slice via the flow control valve.

In a headbox for a paper machine according to the present invention, which pertains to the headbox for a concentration controlling type paper machine at least one of the orientation correcting arrangement comprises a plurality of paper thickness direction correcting arrangements overlapping in the direction of paper thickness for correcting the pulp fiber orientation in the paper thickness direction by supplying a correction flow via respective flow control valves.

In a headbox for a paper machine according to the present invention, which pertains to the headbox for a paper machine, the orientation correcting arrangement uses concentration-controlled paper raw material when the correction flow flows to a location which is to become an end product in the direction of paper width.

In a headbox for a paper machine according to the present invention, which pertains to the headbox for a paper machine, the orientation correcting arrangement uses concentration-controlled paper raw material.

In a headbox for a paper machine according to the present invention, which pertains to the headbox for a paper machine, the orientation correcting arrangement comprises a flowmeter on a pipe provided with the flow control valve, and the headbox further comprises a fiber orientation sensor for measuring the pulp fiber orientation of the manufactured paper, and control arrangement for controlling the flow control valve on the basis of pulp fiber orientation data for the manufactured paper obtained by the fiber orientation sensor, and data from the flowmeter.

Effects of the Invention

As described in detail above, the headbox for a paper machine according to the present invention comprises an orientation correcting arrangement for correcting the pulp fiber orientation by supplying paper raw material as a correction flow to a single location in a central portion of the slice or a plurality of locations on the slice via at least one flow control valve, and is therefore capable of correcting the pulp fiber orientation over the entire width of the slice, even when the slice width is great.

The headbox for a paper machine according to the present invention comprises an orientation correcting arrangement for correcting the pulp fiber orientation by supplying the paper raw material, which is extracted from a taper header in which paper raw material for a main flow is stored or from a correction-only taper header in which paper raw material for correcting the pulp fiber orientation is stored, as a correction flow to a plurality of locations on the slice, other than the two end portions thereof, via at least one flow control valve, and is therefore capable of correcting the pulp fiber orientation over the entire width of the slice, even when the slice width is great.

The headbox for a paper machine according to the present invention comprises an orientation correcting arrangement for correcting the pulp fiber orientation by supplying paper raw material extracted from the taper header or correction-only taper header as a correction flow to the two end portions of the slice via the flow control valve, and is therefore capable of correcting the fiber orientation in the vicinity of the two end portions of the slice.

In the headbox for a paper machine according to the present invention, at least one arrangement of the orientation correcting arrangement comprises a plurality of paper thickness direction correcting arrangement overlapping in the direction of paper thickness for correcting the pulp fiber orientation in the paper thickness direction by supplying a correction flow via respective flow control valves, and hence the pulp fiber orientation can be corrected in the paper thickness direction from the rear surface to the front surface of the paper.

In the headbox for a paper machine according to the present invention, the orientation correcting arrangement use concentration-controlled paper raw material when the correction flow flows to a location which is to become an end product in the direction of paper width, and hence a deterioration of the paper quality caused by the correction flow is prevented, enabling a predetermined level of quality to be maintained.

In the headbox for a paper machine according to the present invention, the orientation correcting arrangement uses concentration-controlled paper raw material, and hence the paper produced by the correction flow can also be used as an end product.

The headbox for a paper machine according to the present invention comprises a control arrangement or system for controlling the flow control valve on the basis of pulp fiber orientation data for the manufactured paper obtained by the fiber orientation sensor, and data from the flowmeter, and hence automatic control of the fiber orientation of the paper can be performed, enabling laborsaving in the manufacturing operation.

The invention also provides for a headbox for a paper machine which discharges paper raw material onto a wire as a raw material jet from a slice supplied with the paper raw material, comprising an orientation correcting arrangement for correcting a pulp fiber orientation by supplying the paper raw material as a correction flow to a single location in a central portion of the slice. The paper raw material is one of extracted from a taper header in which paper raw material for a main flow is stored and extracted from a correction-only taper header in which paper raw material for correcting the pulp fiber orientation is stored.

The orientation correcting arrangement may comprises a flow control valve. The headbox may further comprise another orientation correcting arrangement for correcting the pulp fiber orientation by supplying the paper raw material as a correction flow to two end portions of the slice. The headbox may further comprise another orientation correcting arrangement for correcting the pulp fiber orientation by supplying the paper raw material as a correction flow to two end portions of the slice via flow control valves. At least one of said orientation correcting arrangements may comprise a plurality of paper thickness direction correcting arrangements overlapping in a direction of paper thickness for correcting the pulp fiber orientation in the paper thickness direction by supplying a correction flow. At least one of said orientation correcting arrangements may comprise a plurality of paper thickness direction correcting arrangements overlapping in a direction of paper thickness for correcting the pulp fiber orientation in the paper thickness direction by supplying a correction flow via flow control valves. The orientation correcting arrangement may utilize concentration-controlled paper raw material. The orientation correcting arrangement may utilizes concentration-controlled paper raw material when said correction flow flows to a location which is to become an end product in a direction of paper width. The orientation correcting arrangement may comprise a flowmeter, a pipe and a flow control valve. The headbox may further comprise a fiber orientation sensor for measuring the pulp fiber orientation and a control system for controlling said flow control valve on a basis of pulp fiber orientation data for manufactured paper obtained by said fiber orientation sensor, and data from said flowmeter. The orientation correcting arrangement may comprise a flow pipe, a flow meter, a branch header and a flow control valve.

The invention also provides for a headbox for a paper machine which discharges paper raw material onto a wire as a raw material jet from a slice supplied with the paper raw material, comprising an orientation correcting arrangement for correcting a pulp fiber orientation by supplying the paper raw material as a correction flow to a plurality of locations on the slice, other than two end portions thereof. The paper raw material is one of extracted from a taper header in which paper raw material for a main flow is stored and extracted from a correction-only taper header in which paper raw material for correcting the pulp fiber orientation is stored.

The orientation correcting arrangement may comprises a flow control valve. The headbox may further comprise another orientation correcting arrangement for correcting the pulp fiber orientation by supplying the paper raw material as a correction flow to two end portions of the slice. The headbox may further comprise another orientation correcting arrangement for correcting the pulp fiber orientation by supplying the paper raw material as a correction flow to two end portions of the slice via flow control valves. At least one of said orientation correcting arrangements may comprise a plurality of paper thickness direction correcting arrangements overlapping in a direction of paper thickness for correcting the pulp fiber orientation in the paper thickness direction by supplying a correction flow. At least one of said orientation correcting arrangements may comprise a plurality of paper thickness direction correcting arrangements overlapping in a direction of paper thickness for correcting the pulp fiber orientation in the paper thickness direction by supplying a correction flow via flow control valves. The orientation correcting arrangement may utilize concentration-controlled paper raw material. The orientation correcting arrangement may utilizes concentration-controlled paper raw material when said correction flow flows to a location which is to become an end product in a direction of paper width. The orientation correcting arrangement may comprise a flowmeter, a pipe and a flow control valve. The headbox may further comprise a fiber orientation sensor for measuring the pulp fiber orientation and a control system for controlling said flow control valve on a basis of pulp fiber orientation data for manufactured paper obtained by said fiber orientation sensor, and data from said flowmeter. The orientation correcting arrangement may comprise a flow pipe, a flow meter, a branch header and a flow control valve.

The invention also provides for a method of correcting a pulp fiber orientation in a headbox of a paper machine, wherein the method comprises supplying a paper raw material as a correction flow to a plurality of locations on a slice utilizing an orientation correcting arrangement and one of extracting the paper raw material from a taper header in which paper raw material for a main flow is stored and extracted from a correction-only taper header in which paper raw material for correcting the pulp fiber orientation is stored.

The supplying may comprise supplying the paper raw material as a correction flow to a single location in a central portion of the slice. The supplying may comprise supplying the paper raw material as a correction flow to a plurality of locations on the slice, other than two end portions thereof. The supplying may comprise supplying the paper raw material as a correction flow to two end portions thereof and to a single location in a central portion of the slice. The supplying may comprise supplying the paper raw material as a correction flow to two end portions thereof and to a plurality of locations on the slice other than the two end portions thereof.

BRIEF DESCRIPTION OF THE DRAWINGS

The present invention is further described in the detailed description which follows, in reference to the noted plurality of drawings of exemplary embodiments of the present invention, wherein.

DETAILED DESCRIPTION OF THE INVENTION

Preferred embodiments of the present invention will be described below with reference to the attached drawings.

First Embodiment

Figure 1:
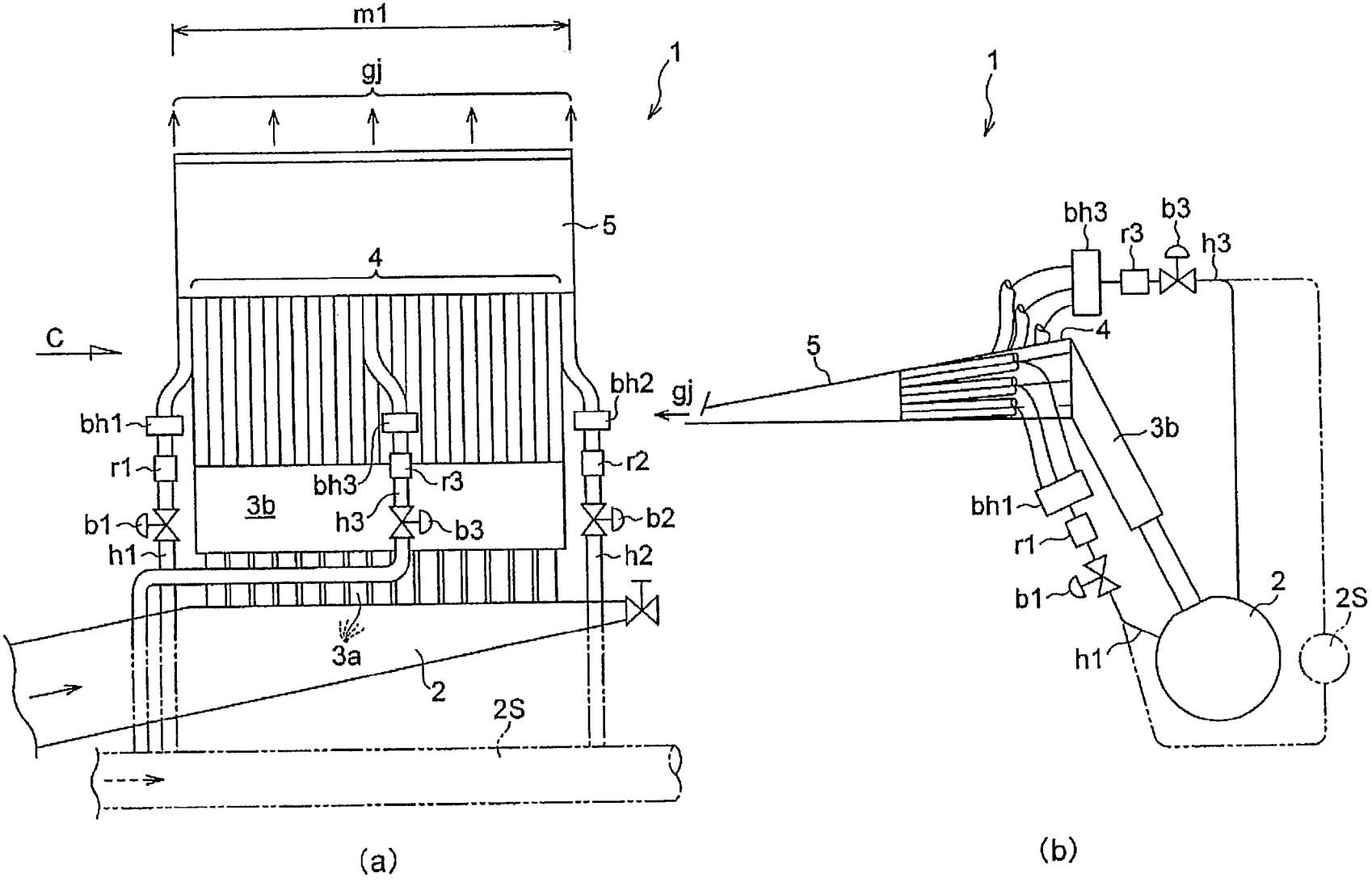
FIGS. 1(*a*) and (*b*) are a schematic top view of a headbox for a non-concentration controlling type paper machine of a first embodiment according to the present invention, and a schematic view seen from the direction of an arrow C, showing the interior of the headbox in FIG. 1(*a*)

In a headbox 1 for a non-concentration controlling type paper machine according to the first embodiment to which the present invention is applied, as shown in FIG. 1(*a*), which is a schematic top view thereof, and FIG. 1(*b*), which is a schematic view seen from the direction of an arrow C, illustrating the interior of the headbox 1 of FIG. 1(*a*), pulp raw material of a predetermined concentration is stored in a taper header 2 for creating a main flow to become the end product paper. The pulp raw material inside the taper header 2 is conveyed to a slice 5 as a main flow through a manifold tube 3*a*, a chamber 3*b*, and a turbulence generator 4.

Note that, for example, the turbulence generator 4 has a three-level pipe form in the vertical direction of the paper surface in FIG. 1(*b*). The inlets on the chamber 3*b* side each have a circular cross-section. The outlets on the slice 5 side have a pentagonal cross-section at the upper level and lower level, and a hexagonal cross-section at the middle level. The configuration of the turbulence generator 4 is not limited to the configuration described above.

As described above, the pulp raw material that is conveyed to the slice 5 is discharged onto a wire (not shown) as a raw material jet "gj" at a maximum velocity of approximately 2000 m/min, or a velocity between 1200 and 1300 m/min for high-quality paper, for example.

Further, correction flow pipes (an orientation correcting arrangement) h1, h2 for correcting the fiber orientation are disposed at both ends of the turbulence generator 4 in the headbox 1. The pipes h1, h2 are connected to the taper header 2, comprise flow control valves b1, b2, flowmeters r1, r2, and branch headers bh1, bh2, and are thus connected to the slice 5.

Also in the headbox 1, a correction flow pipe (another orientation correcting arrangement) h3 is connected to the taper header 2, comprises a flow control valve b3, a flowmeter r3, and a branch header bh3, and is disposed in the central portion of the turbulence generator 4 so as to be connected to a central portion of the slice 5.

Correction flows of the pulp raw material are supplied to the slice 5 from the correction flow pipes h1, h2, h3, and discharged as the raw material jet "gj" together with the main flow that is supplied to the slice 5.

Here, when the flow velocity of the correction flow is faster than the flow velocity of the main flow in the turbulence generator 4, the orientation of the pulp fibers in the main flow is corrected to an orientation that moves away from the correction flow, whereas when the flow velocity of the correction flow is slower than the flow velocity of the main flow in the turbulence generator 4, the orientation of the pulp fibers in the main flow is corrected to an orientation that approaches the correction flow side.

For example, focussing on the correction flow on the two sides of the turbulence generator 4, when the flow velocity of the correction flow is faster than the flow velocity of the main flow in the turbulence generator 4, the orientation of the pulp fibers in the main flow is corrected to face inside, whereas when the flow velocity of the correction flow is slower than the flow velocity of the main flow in the turbulence generator 4, the orientation of the pulp fibers in the main flow is corrected to face outside.

Here, an example is shown in which the correction flow pipe h3 in the central portion is provided in a single location, but a plurality of the correction flow pipes h3 may be provided in a plurality of locations other than the two end portions.

For example, a width "m1" of the slice 5 in the paper machine may be between three and four meters, or in a large paper machine, may be ten meters.

Accordingly, when the width "m1" of the slice 5 is between three and four meters, the correction flow pipe h3 may be provided in a single location in the central portion, and when the width "m1" of the slice 5 is ten meters, a plurality of the correction flow pipes h3 may be provided in a plurality of locations every three meters other than at the two end portions.

The pulp raw material placed on the wire in this manner is drained of water by natural dehydration while being conveyed, then pressed by a roll (not shown) to be further drained of water, then drained further by the application of heat and vaporization, and thus formed into paper.

According to the constitution described above, the correction flow pipes h1, h2, h3 are provided not only on the two end portions of the turbulence generator 4, but also in a single location in the central portion or in a plurality of locations other than the two end portions of the turbulence generator 4, and hence by regulating the flow rate using the flow control valves on each of the correction flow pipes so as to vary the flow velocity of the pulp raw material, regulation of the pulp orientation of the paper can be performed over the entire width of the slice even in the headbox 1 which has a large slice width "m1".

Note that, as shown by the double-dash line in FIG. 1, a correction-only taper header 2*s* in which the pulp raw material for correcting the fiber orientation is stored may be provided in this headbox 1 separately to the taper header 2 such that the correction flow pipes h1, h2, h3 are connected to the correction-only taper header 2*s* rather than the taper header 2.

According to this variation, the pressure and so on of the pulp raw material inside the correction-only taper header 2*s* can be modified appropriately, freely, and independently of the taper header 2. Hence regulation of the fiber orientation of the paper using correction pipes can be performed in a wider scope.

Second Embodiment

The second embodiment is constituted such that in the paper machine headbox according to the first embodiment, a plurality of correction flow pipes are disposed in the direction of paper thickness, and a flow control valve is attached to each pipe so that the fiber orientation can be regulated in the direction of paper thickness.

All other features are identical to the configuration of the first embodiment. Hence identical reference symbols, with the addition of ' (a prime), are allocated to identical elements, and description is provided only for different features.

Figure 2:
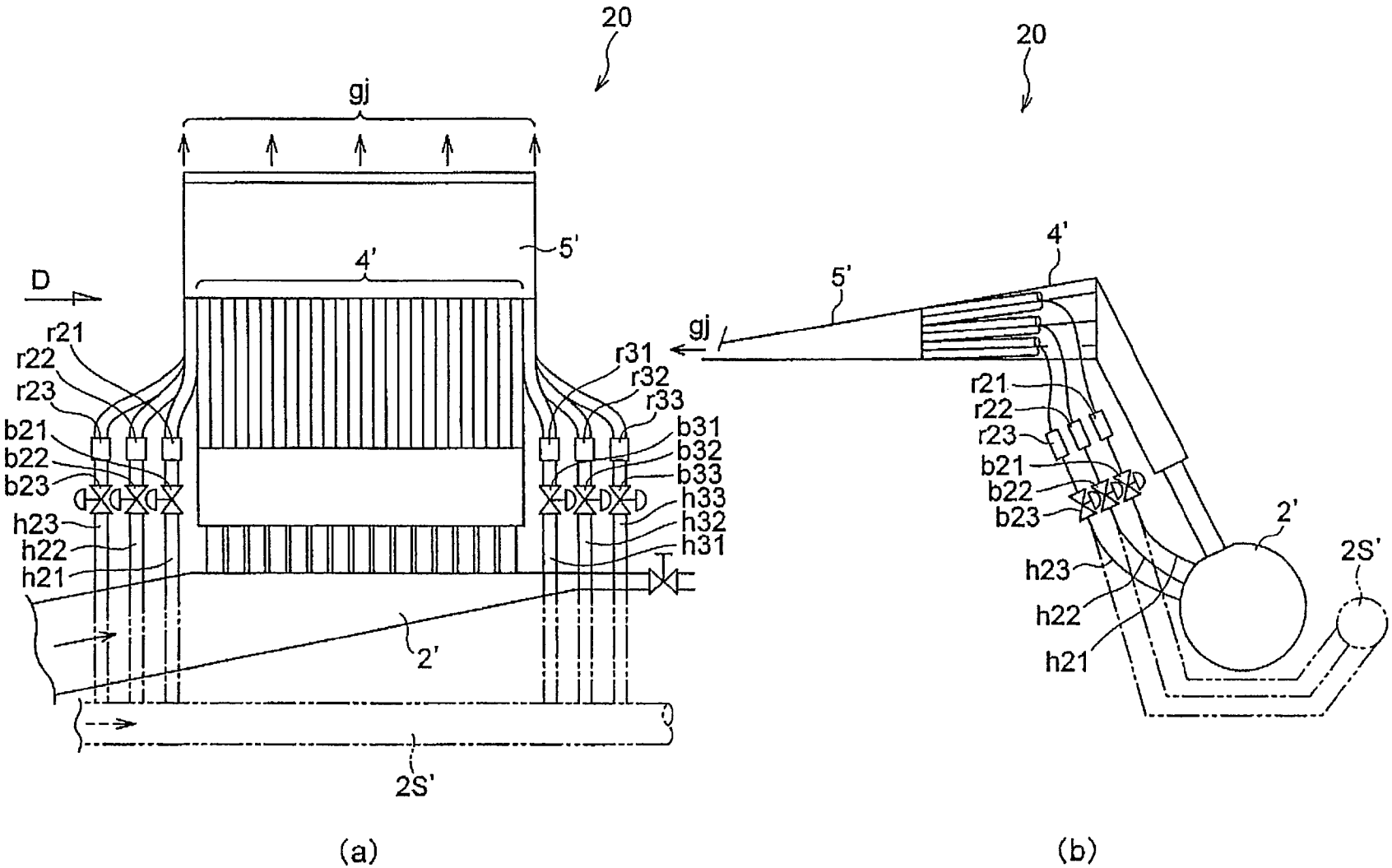
FIGS. 2(*a*) and (*b*) are a schematic top view of a headbox for a non-concentration controlling type paper machine of a second embodiment according to the present invention, and a schematic view seen from the direction of an arrow D, showing the interior of the headbox in FIG. 2(*a*)

In a headbox 20 for a paper machine of the second embodiment, as shown in FIG. 2(*a*), which is a schematic top view thereof, and FIG. 2(*b*), which is a schematic view seen from the direction of an arrow D, illustrating the interior of the headbox of FIG. 2(*a*), correction flow pipes (an orientation correcting arrangement and a paper thickness direction correcting arrangement) h21, h22, h23 are disposed at one end of a turbulence generator 4', connected to a taper header 2', comprise flow control valves b21, b22, b23 and flowmeters r21, r22, r23, and are thus connected to a slice 5'.

Correction flow pipes (an orientation correcting arrangement and a paper thickness direction correcting arrangement) h31, h32, h33 are disposed at the other end of the turbulence generator 4', connected to the taper header 2', comprise flow control valves b31, b32, b33 and flowmeters r31, r32, r33, and are thus connected to the slice 5'.

Note that, as shown by the double-dash line in FIG. 2, a correction-only taper header 2*s*', in which pulp raw material for correcting the fiber orientation is stored, may be provided in this headbox 20 separately to the taper header 2' such that the correction flow pipes h21, h22, h23 on one end of the turbulence generator 4' are connected to the correction-only taper header 2*s*' rather than the taper header 2'. The correction flow pipes h31, h32, h33 on the other end of the turbulence generator 4' are connected to the correction-only taper header 2*s*' rather than the taper header 2'.

According to this configuration, the correction flow pipes for correcting the fiber orientation of the paper are disposed so as to overlap in the direction of paper thickness, and can be controlled by their respective flow control valves. Hence, by varying the flow velocity of the pulp raw material that flows through the respective pipes, the fiber orientation can be regulated to become uniform from the front surface of the paper to the rear surface of the paper.

Further, by constituting the headbox 20 such that the correction flow pipes h21, h22, h23 and the correction flow pipes h31, h32, h33 are connected to the correction-only taper header 2*s*' rather than the taper header 2', pressure control and so on of the correction-only taper header 2*s*' can be performed freely and independently of the taper header 2', enabling correction of the fiber orientation to be performed in a wider scope.

Next, a headbox 21 for a paper machine according to a modified example of the second embodiment will be described.

Figure 3:
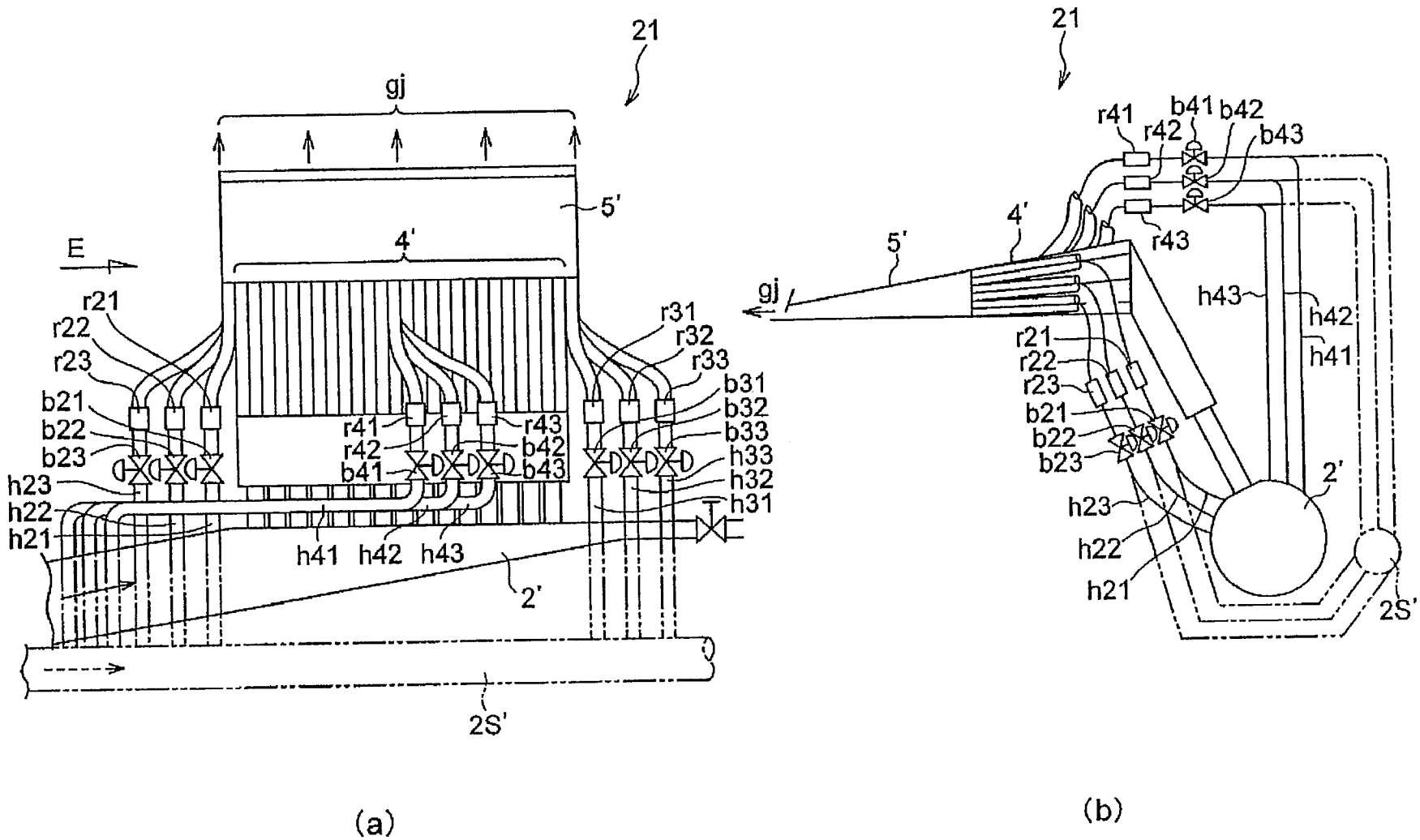
FIGS. 3(*a*) and (*b*) are a schematic top view of a headbox for a non-concentration controlling type paper machine of a modified example of the second embodiment according to the present invention, and a schematic view seen from the direction of an arrow E, showing the interior of the headbox in FIG. 3(*a*)

In the headbox 21 for a paper machine, as shown in FIG. 3(*a*), which is a schematic top view thereof, and FIG. 3(*b*), which is a schematic view seen from the direction of an arrow E, illustrating the interior of the headbox 21 of FIG. 3(*a*), in addition to the correction flow pipes h21, h22, h23 disposed at one end of the turbulence generator 4' and the correction flow pipes h31, h32, h33 disposed at the other end of the turbulence generator 4', correction flow pipes (an orientation correcting arrangement and a paper thickness direction correcting arrangement) h41, h42, h43 for correcting the fiber orientation are disposed in a central portion of the turbulence generator 4', connected to the taper header 2', comprise flow control valves b41, b42, b43 and flowmeters r41, r42, r43, and are thus connected to a central portion of the slice 5'.

Note that, as shown by the double-dash line in FIG. 3, the central portion correction flow pipes h41, h42, h43 may be connected to the correction-only taper header 2*s*' rather than the taper header 2'.

Further, an example is shown in which the fiber orientation correction flow pipes h41, h42, h43 in the central portion of the turbulence generator 4' are disposed in a single location, but the pipes may be disposed in a plurality of locations other than the two end portions.

According to this configuration, the correction flow pipes h41, h42, h43 are disposed in the central portion of the turbulence generator 4', and the flow rates thereof are regulated by the respective flow control valves b41, b42, b43. Hence the fiber orientation can be regulated to become uniform from the front surface of the paper to the rear surface of the paper in the central portion of the slice 5'.

Note that by disposing the correction flow pipes not only in a single location in the central portion of the turbulence generator 4', but also in a plurality of locations other than the two end portions of the turbulence generator 4', regulation can be performed in a wider region of the width of the slice 5'.

Further, by connecting the correction flow pipes h41, h42, h43 in a single location in the central portion or the correction flow pipes in a plurality of locations to the correction-only taper header 2*s*', the correction-only taper header 2*s*' can be controlled freely and independently of the taper header 2', enabling correction of the fiber orientation in a wider scope.

Third Embodiment

The third embodiment differs from the headboxes for a non-concentration controlling type paper machine of the first and second embodiments in that it is applied to a headbox 30 for a concentration controlling type paper machine.

Figure 4:
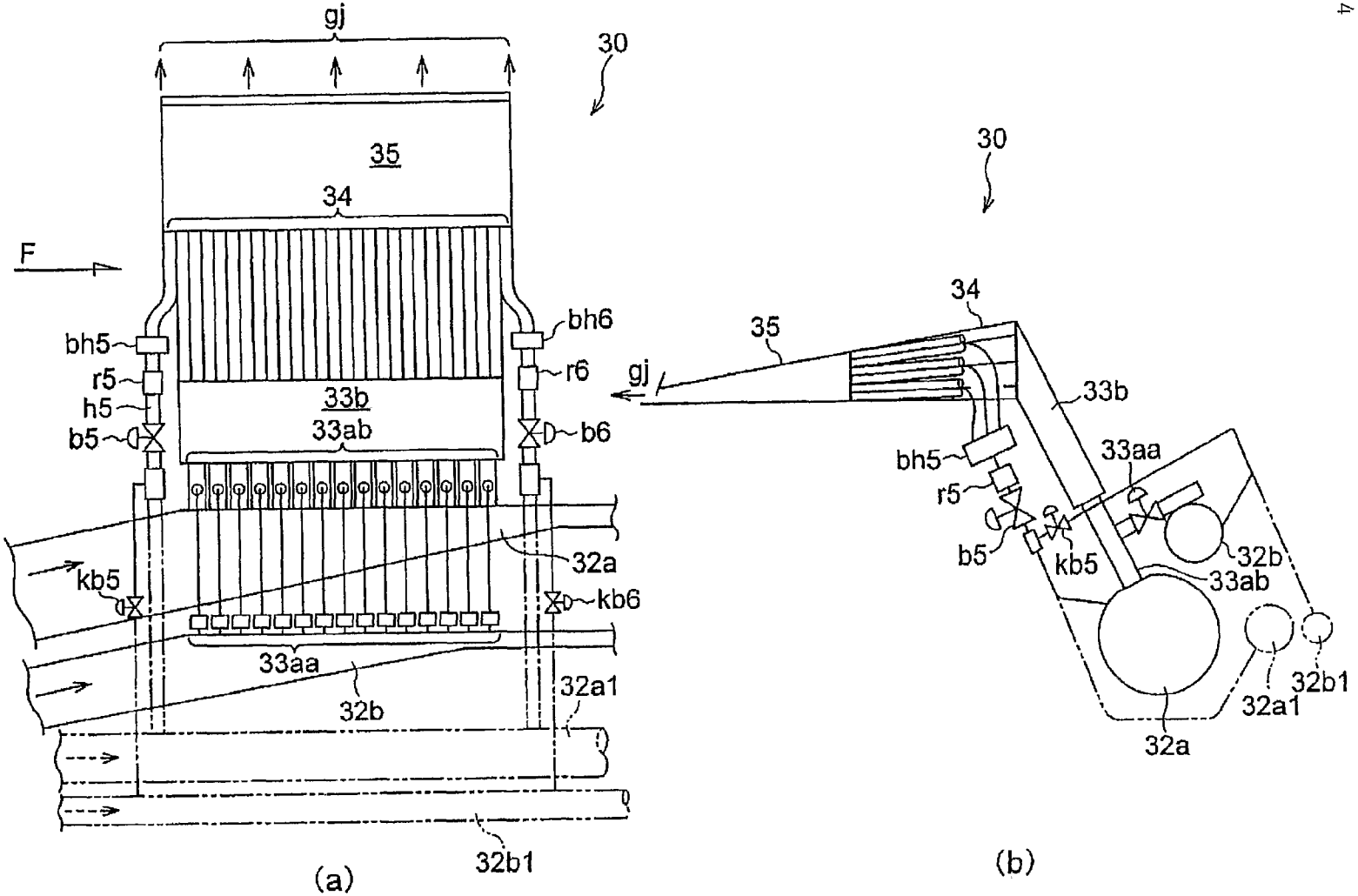
FIGS. 4(*a*) and (*b*) are a schematic top view of a headbox for a concentration controlling type paper machine of a third embodiment according to the present invention, and a schematic view seen from the direction of an arrow F, showing the interior of the headbox in FIG. 4(*a*)

In the headbox 30 for a concentration controlling type paper machine, as shown in FIG. 4(*a*), which is a schematic top view thereof, and FIG. 4(*b*), which is a schematic view seen from the direction of an arrow F in FIG. 4(*a*), high concentration pulp raw material is stored in a high concentration taper header 32*a*, and dilution water is stored in a dilution water taper header 32*b*.

The high concentration taper header 32*a* is connected to a mixing chamber 33*b* via a module jet mixing chamber 33*ab*, and the dilution water taper header 32*b* is connected to the mixing chamber 33*b* via a module jet bulb 33*aa*.

The mixing chamber 33*b* is connected to a slice 35 via a turbulence generator 34, whereby the high concentration pulp raw material inside the high concentration taper header 32*a* and the dilution water inside the dilution water taper header 32*b* are supplied to the slice 35 as a main flow.

In this headbox 30 for a paper machine, correction flow pipes (an orientation correcting arrangement) h5, h6 are disposed at both ends of the turbulence generator 34, connected to the high concentration taper header 32*a*, comprise flow control valves b5, b6, flowmeters r5, r6, and branch headers bh5, bh6, and are thus connected to the slice 35.

The correction flow pipe h5 further comprises a flow control valve kb5 so as to be connected to the dilution water taper header 32*b*, and the correction flow pipe h6 further comprises a flow control valve kb6 so as to be connected to the dilution water taper header 32*b*.

Thus high concentration pulp raw material and dilution water flow through the correction flow pipes h5, h6 to the slice 35.

By way of the configuration described above, the high concentration pulp raw material and dilution water transmitted from the high concentration taper header 32*a* and dilution water taper header 32*b* through the module jet mixing chamber 33*ab* or the module jet bulb 33*aa*, the mixing chamber 33*b*, the turbulence generator 34, the correction flow pipes h5, h6, and so on are discharged as a raw material jet gj onto a wire (not shown).

Here, the correction flow flows from the correction flow pipes h5, h6 to the slice $5^1$, and hence when the flow velocity of the correction flow is faster than the flow velocity of the main flow in the turbulence generator $4^2$, the orientation of the pulp fibers in the main flow is corrected to an orientation that moves away from the correction flow.

On the other hand, when the flow velocity of the correction flow is slower than the flow velocity of the main flow in the turbulence generator 34, the orientation of the pulp fibers in the main flow is corrected to an orientation that approaches the correction flow side.

The pulp raw material placed on the wire in this manner is drained of water by natural dehydration while being conveyed, then pressed by a roll (not shown) to be further drained of water, then drained further by the application of heat and vaporization, and thus formed into paper.

Figure 9:
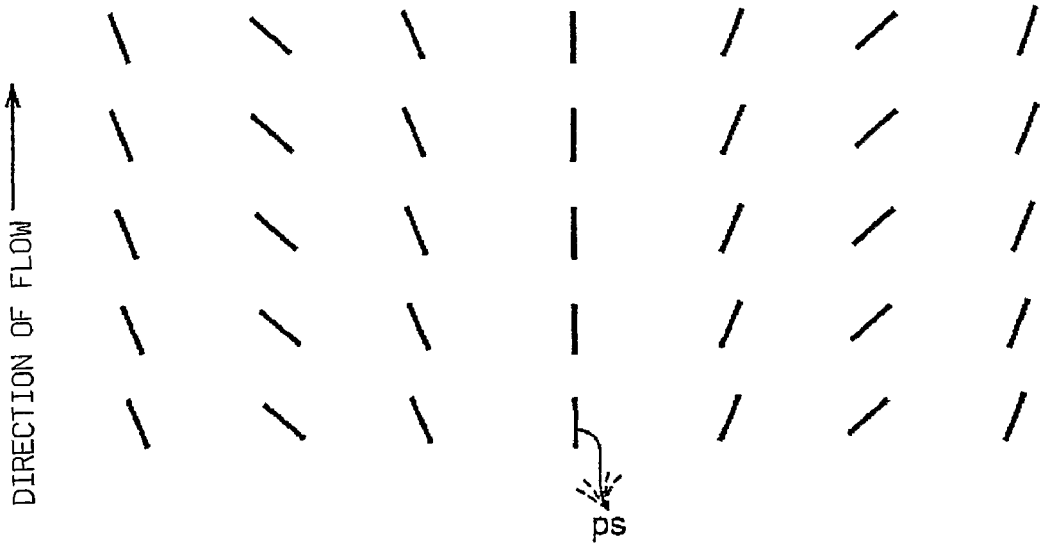
FIGS. 9(*a*) and (*b*) are a view showing an example of the disposal of pulp fibers ps in relation to the flow direction of a raw material jet of the paper manufactured by the paper machine, and an enlarged sectional view showing in detail the thickness direction of the paper.
Figure 9:
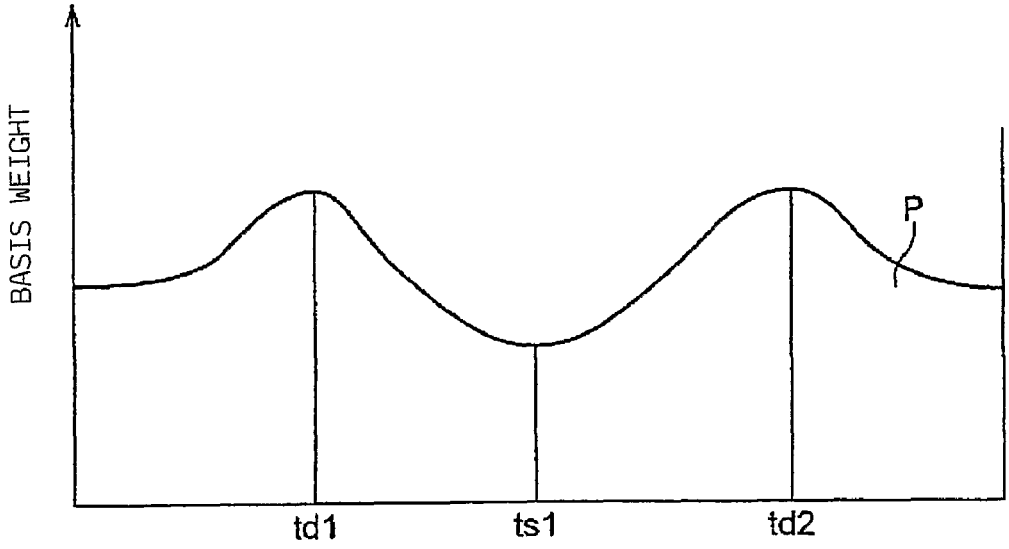
Figure 10:
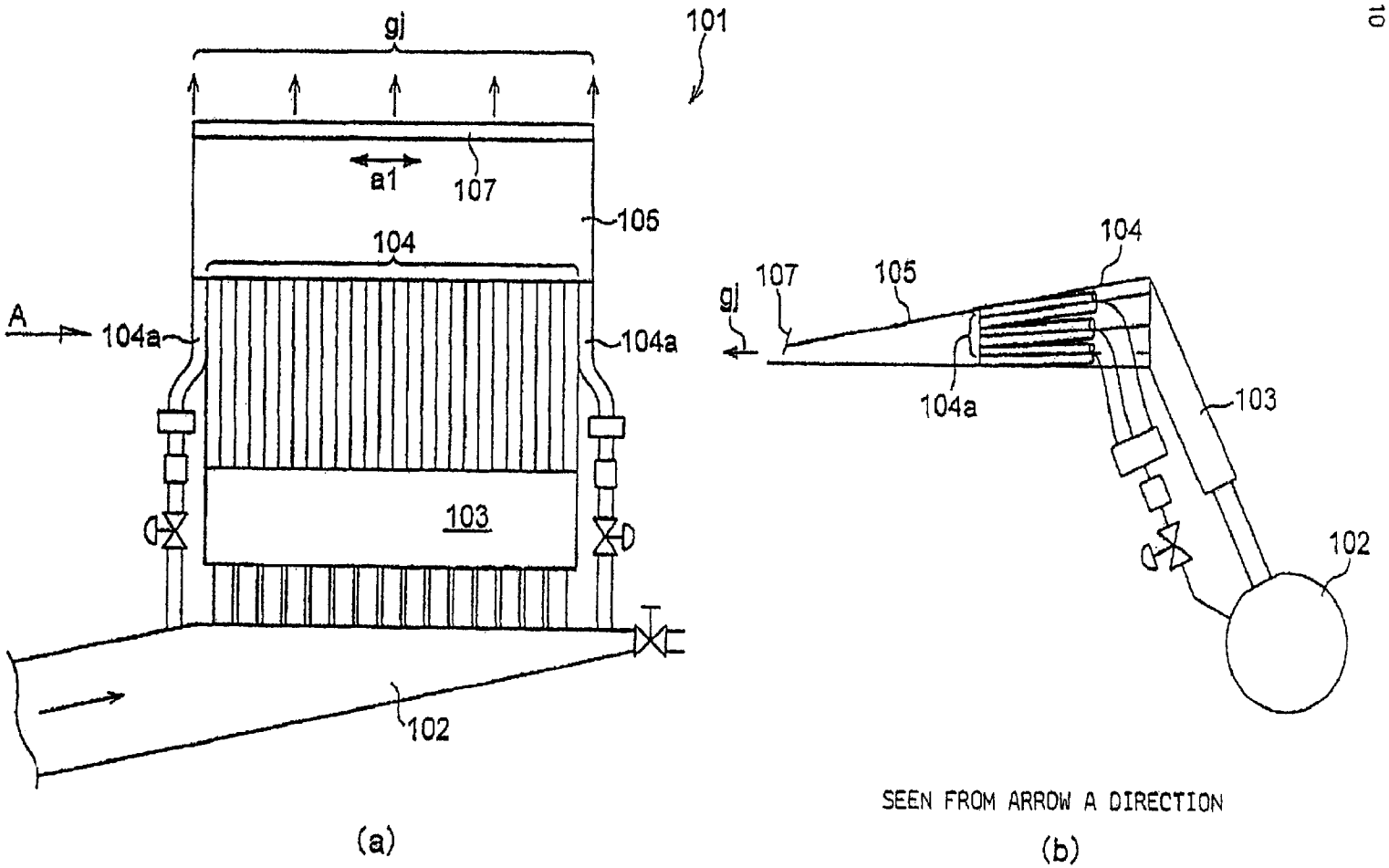
FIGS. 10(*a*) and (*b*) are a schematic top view of a headbox for a conventional non-concentration controlling type paper machine, and a schematic view seen from the direction of an arrow A, showing the interior of the headbox in FIG. 10(*a*)
Figure 11:
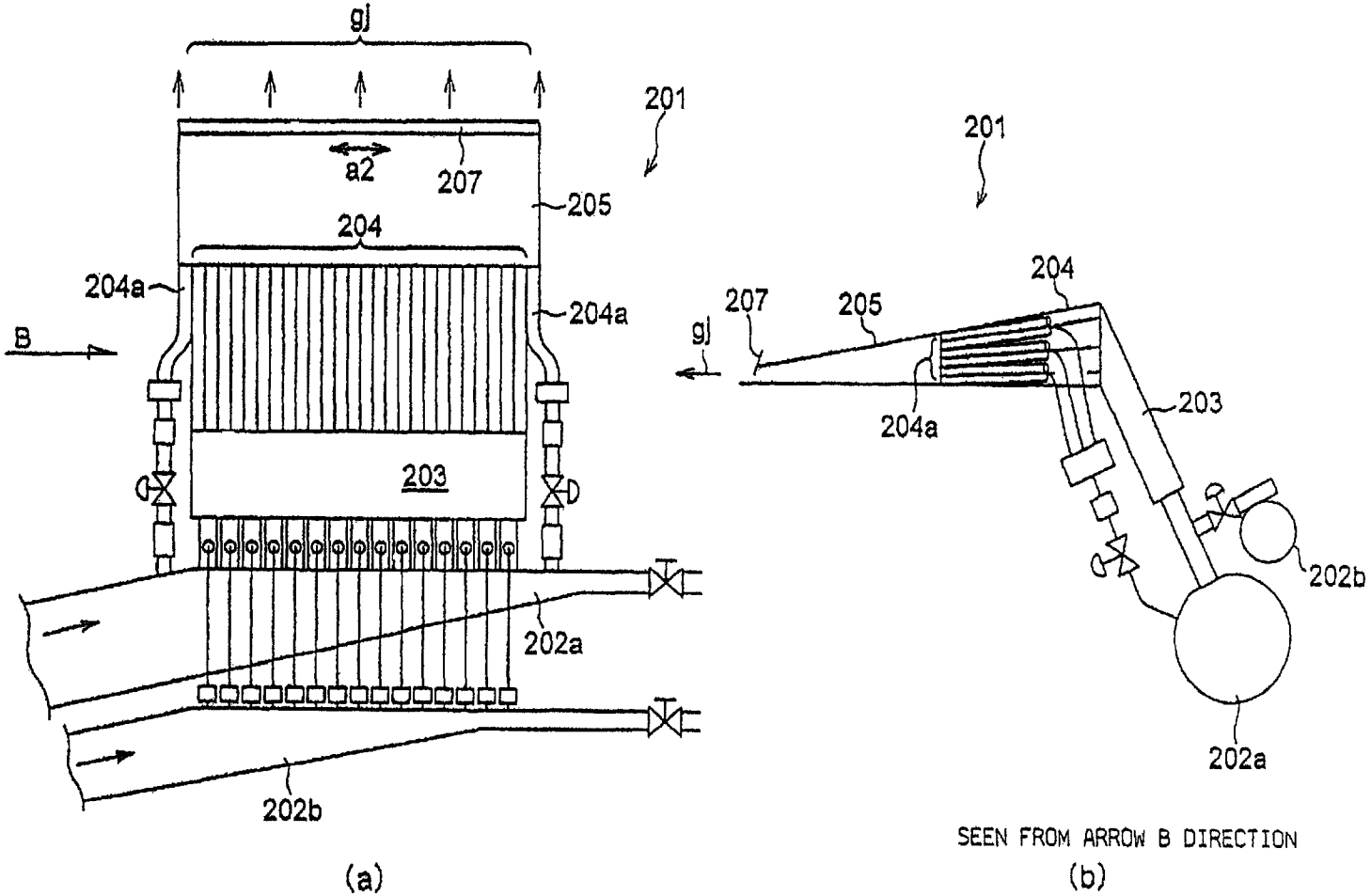
FIGS. 11(*a*) and (*b*) are a schematic top view of a headbox for a conventional concentration controlling type paper machine, and a schematic view seen from the direction of an arrow B, showing the interior of the headbox in FIG. 11(*a*).

Here, as shown in FIG. 9(*b*), which is an enlarged sectional view of a sheet of paper "p" in the direction of thickness, when the high concentration pulp raw material and dilution water are mixed such that there is a large amount of high concentration pulp raw material and little dilution water, the basis weight increases (td1, td2 in FIG. 9(*b*)) and the paper becomes thicker, whereas when there is little high concentration pulp raw material and a large amount of dilution water, the basis weight decreases ("ts1" in FIG. 9(*b*)) and the paper becomes thinner.

Incidentally, extraction of the raw material in the orientation correction flow pipes h5, h6 may be set to the high concentration taper header 32*a* alone such that only high concentration pulp raw material is extracted.

According to the configuration described above, a correction flow at the two end portions is present in addition to the main flow on the inside of the slice 35, and hence the fiber orientation of the pulp fibers can be corrected to an inside or outside orientation by varying the flow velocity of the correction flow.

Further, by making the correction flow through the correction flow pipes h5, h6 a mixture of high concentration pulp raw material and dilution water, the correction flow approaches the entire width of the raw material jet "gj" from the slice 35, and can be used as the paper of the end product.

Further, as shown by the double-dash line in FIG. 4, the headbox 30 may also comprise a high concentration taper header for the orientation correction flow only (a correction-only taper header) 32*a*1 and a dilution water taper header for the orientation correction flow only (a correction-only taper header) 32*b*1, whereby the orientation correction flow pipes h5, h6 are connected only to the correction-only high concentration taper header 32*a*1 and the correction-only dilution water taper header 32*b*1 in order to extract high concentration pulp raw material and dilution water.

According to this configuration, control and so on of the high concentration taper header 32*a*1 for the orientation correction flow only and the dilution water taper header 32*b*1 for the orientation correction flow only can be performed freely and independently of the main flow high concentration taper header 32*a* and dilution water taper header 32*b*, and hence regulation of the correction flow can be performed in a wider scope.

Figure 5:
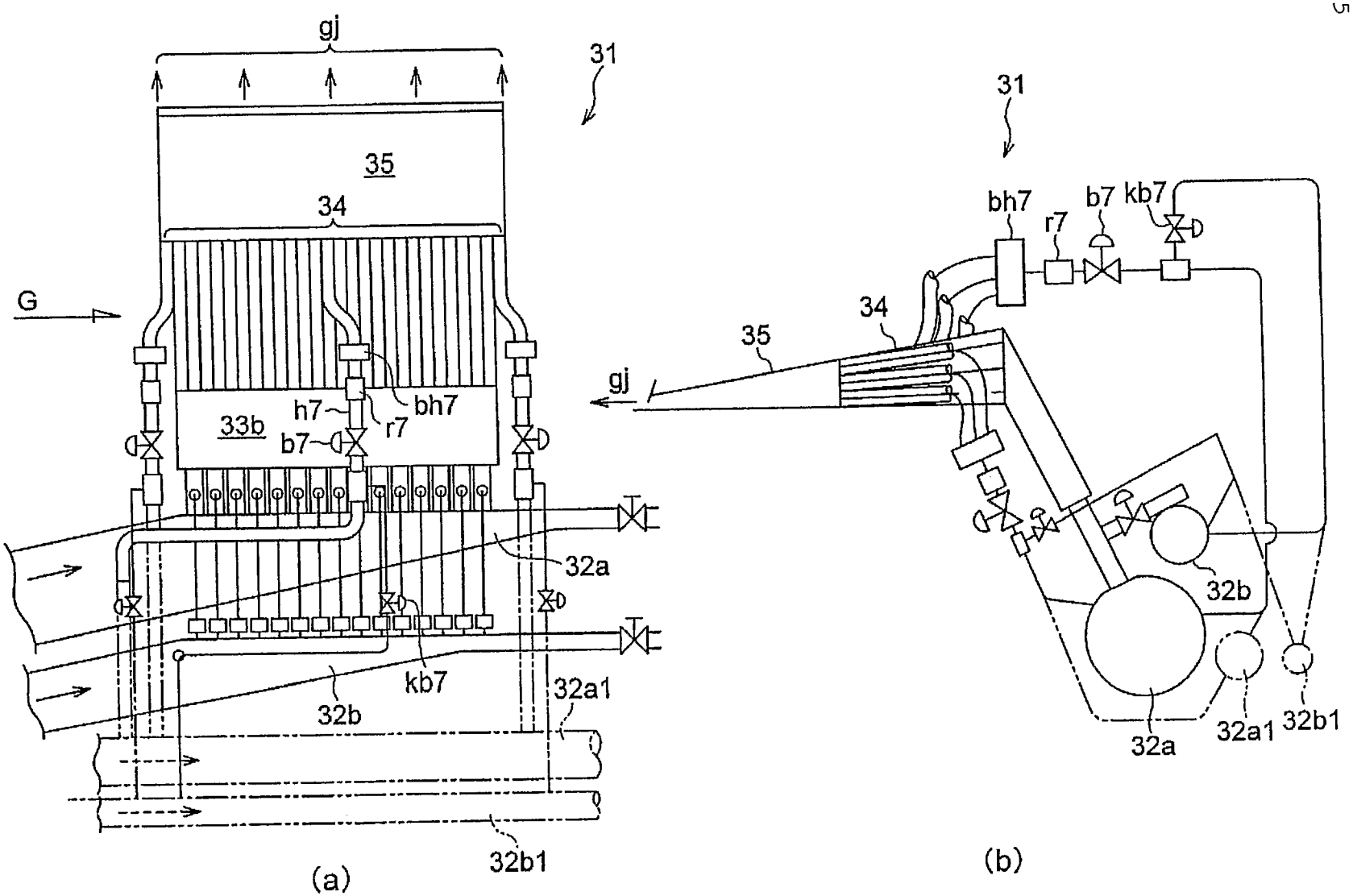
FIGS. 5(*a*) and (*b*) are a schematic top view of a headbox for a concentration controlling type paper machine of a modified example of the third embodiment according to the present invention, and a schematic view seen from the direction of an arrow G, showing the interior of the headbox in FIG. 5(*a*)

FIG. 5 shows a modified example of the third embodiment, comprising an orientation correction flow pipe h7 in the center of the turbulence generator 34 in addition to the orientation correction flow pipes h5, h6.

Note that FIG. 5(*a*) shows a schematic top view of a modified example of the headbox 30 for a concentration controlling type paper machine, and FIG. 5(*b*) shows a schematic view seen from the direction of an arrow G in FIG. 5(*a*).

More specifically, the correction flow pipe (an orientation correcting arrangement) h7 is disposed in a central portion of the turbulence generator 34, connected to the high concentration taper header 32*a*, comprises a flow control valve b7, a flowmeter r7, and a branch header bh7, and is thus connected to a central portion of the slice 35.

The correction flow pipe h7 further comprises a flow control valve kb7 so as to be connected to the dilution water taper header 32*b*.

A plurality of the correction flow pipes h7 may be provided in a plurality of locations, other than the two end portions of the turbulence generator 34, in addition to the correction flow pipe h7 provided in a single location in the central portion of the turbulence generator 34.

Further, as shown by the double-dash line in FIG. 5, the headbox 30 may further comprise the high concentration taper header 32*a*1 for the orientation correction flow only and the dilution water taper header 32*b*1 for the orientation correction flow only, such that the orientation correction flow pipe h7 is connected only to the correction-only high concentration taper header 32*a*1 and the correction-only dilution water taper header 32*b*1 in order to extract high concentration pulp raw material and dilution water.

According to this configuration, correction of the fiber orientation may be performed in a single location in the central portion of the slice 35, or in a plurality of locations other than the two end portions, and hence correction of the fiber orientation can be performed over the entire width of the slice 35 even when the width of the slice 35 is great.

Fourth Embodiment

The fourth embodiment is constituted such that in the paper machine headbox according to the third embodiment, correction flow pipes are disposed in a plurality in the direction of paper thickness, and are each capable of correction control.

All other features are identical to the configuration of the third embodiment. Hence identical reference symbols, with the addition of ' (a dash), are allocated to identical elements, and description is provided only for different features.

Figure 6:
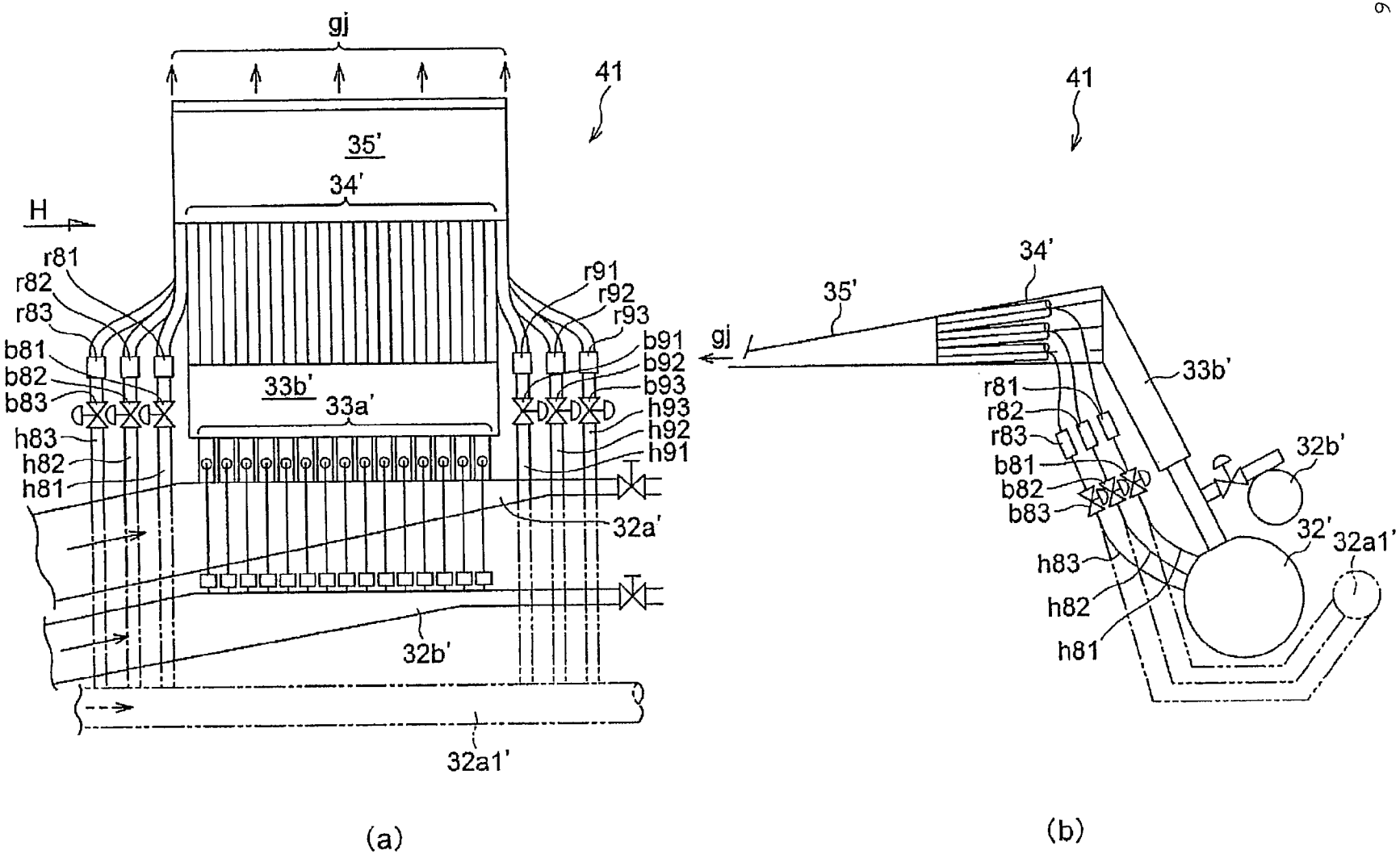
FIGS. 6(*a*) and (*b*) are a schematic top view of a headbox for a concentration controlling type paper machine of a fourth embodiment according to the present invention, and a schematic view seen from the direction of an arrow H, showing the interior of the headbox in FIG. 6(*a*)

In a headbox 41 for a paper machine of the fourth embodiment, as shown in FIG. 6(*a*), which is a schematic top view thereof, and FIG. 6(*b*), which is a schematic view seen from the direction of an arrow H, illustrating the interior of the headbox 41 of FIG. 6(*a*), correction flow pipes (an orientation correcting arrangement and a paper thickness direction correcting arrangement) h81, h82, h83 are disposed at one end of a turbulence generator 34', connected to a high concentration taper header 32*a*', comprise flow control valves b81, b82, b83 and flowmeters r81, r82, r83, and are thus connected to a slice 35'.

Correction flow pipes (an orientation correcting arrangement and a paper thickness direction correcting arrangement) h91, h92, h93 are disposed at the other end of the turbulence generator 34', connected to the high concentration taper header 32*a*', comprise flow control valves b91, b92, b93 and flowmeters r91, r92, r93, and are thus connected to the slice 35'.

Note that, as shown by the double-dash line in FIG. 6, a high concentration-only taper header (correction-only taper header) 32*a*1' to which pulp raw material is supplied to correct the fiber orientation is provided in this headbox 41 separately to the high concentration taper header 32*a'*.

Further, the correction flow pipes h81, h82, h83 on one end of the turbulence generator 34' may be connected to the high concentration-only taper header 32*a*1' rather than the taper header 32*a*', and the correction flow pipes h91, h92, h93 on the other end of the turbulence generator 34' may be connected to the high concentration-only taper header 32*a*1' rather than the high concentration taper header 32*a*'.

According to this constitution, the correction flow pipes h81, h82, h83 and h91, h92, h93 for correcting the fiber orientation of the paper are disposed so as to overlap in the direction of paper thickness, and hence the fiber orientation can be corrected to become uniform over the front surface of the paper and the rear surface of the paper by regulating the flow rate of the high concentration pulp raw material that flows through the respective pipes using the respective flow control valves.

Further, by constituting the headbox 41 such that the correction flow pipes h81, h82, h83 and the correction flow pipes h91, h92, h93 are connected to the high concentration-only taper header 32*a*1' rather than the high concentration taper header 32*a*', control of the high concentration-only taper header 32*a*1' can be performed freely and independently of the high concentration taper header 32*a*', enabling correction of the fiber orientation to be performed in a wider scope.

Fifth Embodiment

The fifth embodiment is constituted such that in the paper machine headbox according to the fourth embodiment, correction flow pipes are connected to a high concentration taper header and a dilution water taper header.

All other features are identical to the constitution of the third and fourth embodiments. Hence identical reference symbols, with the addition of ' (a dash), are allocated to identical elements, and description is provided only for different features.

Figure 7:
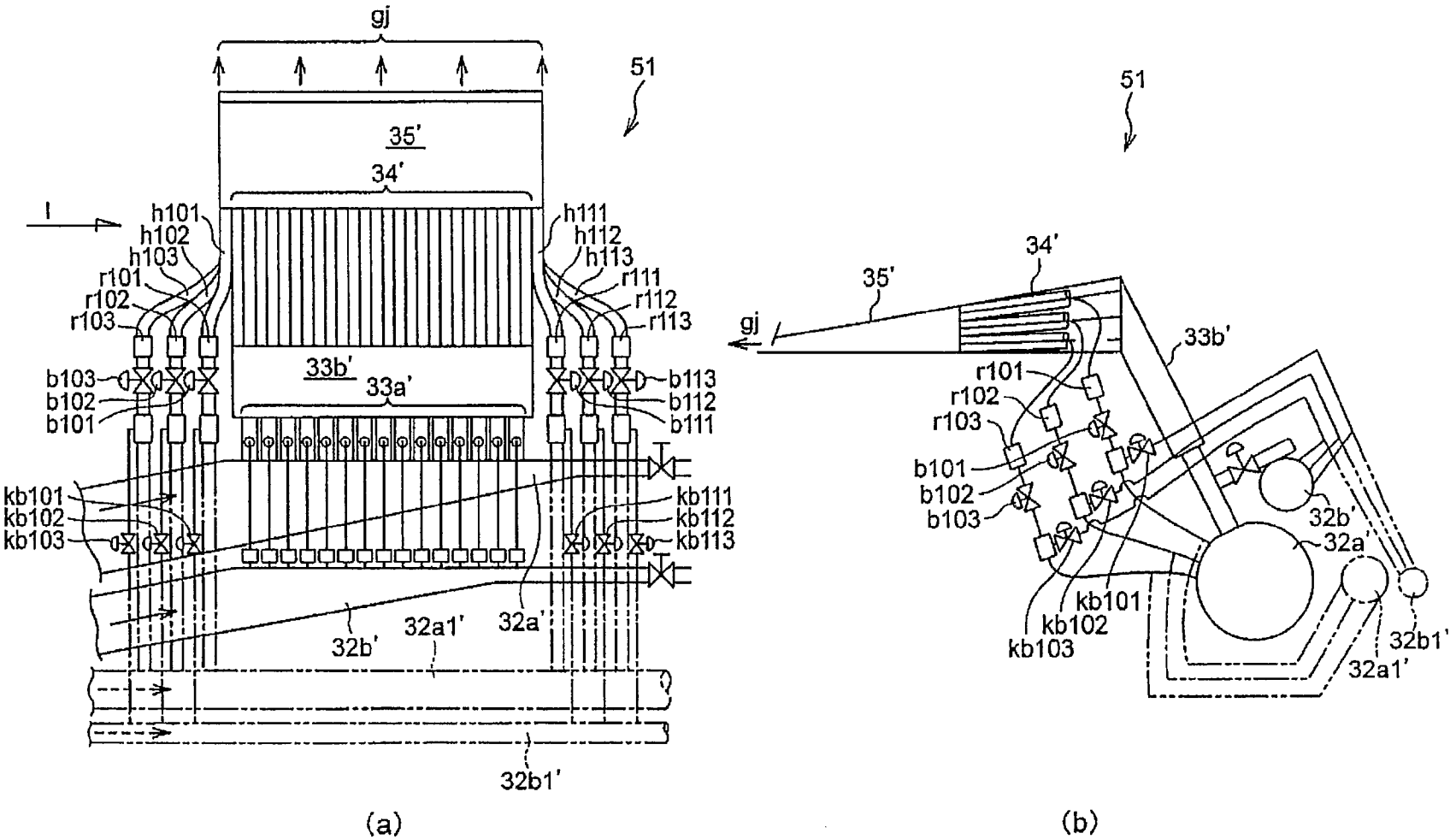
FIGS. 7(*a*) and (*b*) are a schematic top view of a headbox for a concentration controlling type paper machine of a fifth embodiment according to the present invention, and a schematic view seen from the direction of an arrow I, showing the interior of the headbox in FIG. 7(*a*)

In a headbox 51 for a paper machine of the fifth embodiment, as shown in FIG. 7(*a*), which is a schematic top view thereof, and FIG. 7(*b*), which is a schematic view seen from the direction of an arrow I, illustrating the interior of the headbox 51 of FIG. 7(*a*), correction flow pipes (an orientation correcting arrangement and a paper thickness direction correcting arrangement) h101, h102, h103 are disposed at one end of the turbulence generator 34', connected to the high concentration taper header 32*a*', comprise flow control valves b101, b102, b103 and flowmeters r101, r102, r103, and are thus connected to the slice 35'.

The correction flow pipes h101, h102, h103 further comprise flow control valves kb101, kb102, kb103 respectively so as to be connected to a dilution water taper header 32*b*'.

Meanwhile, correction flow pipes (an orientation correcting arrangement and a paper thickness direction correcting arrangement) h111, h112, h113 are disposed at the other end of the turbulence generator 34', connected to the high concentration taper header 32*a*', comprise flow control valves b111, b112, b113 and flowmeters r111, r112, r113, and are thus connected to the slice 35'.

The correction flow pipes h111, h112, h113 further comprise flow control valves kb111, kb112, kb113 respectively so as to be connected to the dilution water taper header 32*b*'.

According to the constitution described above, the plurality of correction flows overlapping in the direction of paper thickness are disposed at the two end portions of the slice 35' in addition to the main flow on the inside of the slice 35', and hence the fiber orientation of the pulp fibers can be corrected from the rear surface to the front surface of the paper by regulating the respective flow rates of each correction flow using the flow control valves.

Moreover, the correction flows produced in the correction flow pipes h101, h102, h103 and the correction flow pipes h111, h112, h113 are flows comprising a mixture of high concentration pulp raw material and dilution water, and hence the correction flow approaches the entire width of the raw material jet "gj" from the slice 35', and can therefore be used as the paper end product.

Note that, as shown by the double-dash line in FIG. 7, the high concentration taper header 32*a*1' for the orientation correction flow only and the dilution water taper header 32*b*1' for the orientation correction flow only (correction-only taper header) may be provided separately, whereby the orientation correction flow pipes h101, h102, h103 and the correction flow pipes hill, h112, h113 are connected only to the correction-only high concentration taper header 32*a*1' and the correction-only dilution water taper header 32*b*1' in order to extract high concentration pulp raw material and dilution water.

According to this configuration, control of the high concentration taper header 32*a*1' for the orientation correction flow only and the dilution water taper header 32*b*1' for the orientation correction flow only can be performed freely and independently of the main flow high concentration taper header 32*a*' and dilution water taper header 32*b*', and hence regulation of the fiber orientation by way of the correction flows can be performed in a wider scope.

Sixth Embodiment

The sixth embodiment is constituted such that further fiber orientation correction flow pipes are added to a central portion of the turbulence generator 34' in the paper machine headbox 51 of the fifth embodiment.

All other features are identical to the features of the third and fifth embodiments. Hence identical reference symbols, with the addition of ' (a dash), are allocated to identical elements to those of the third embodiment, and description is provided only for different features.

Figure 8:
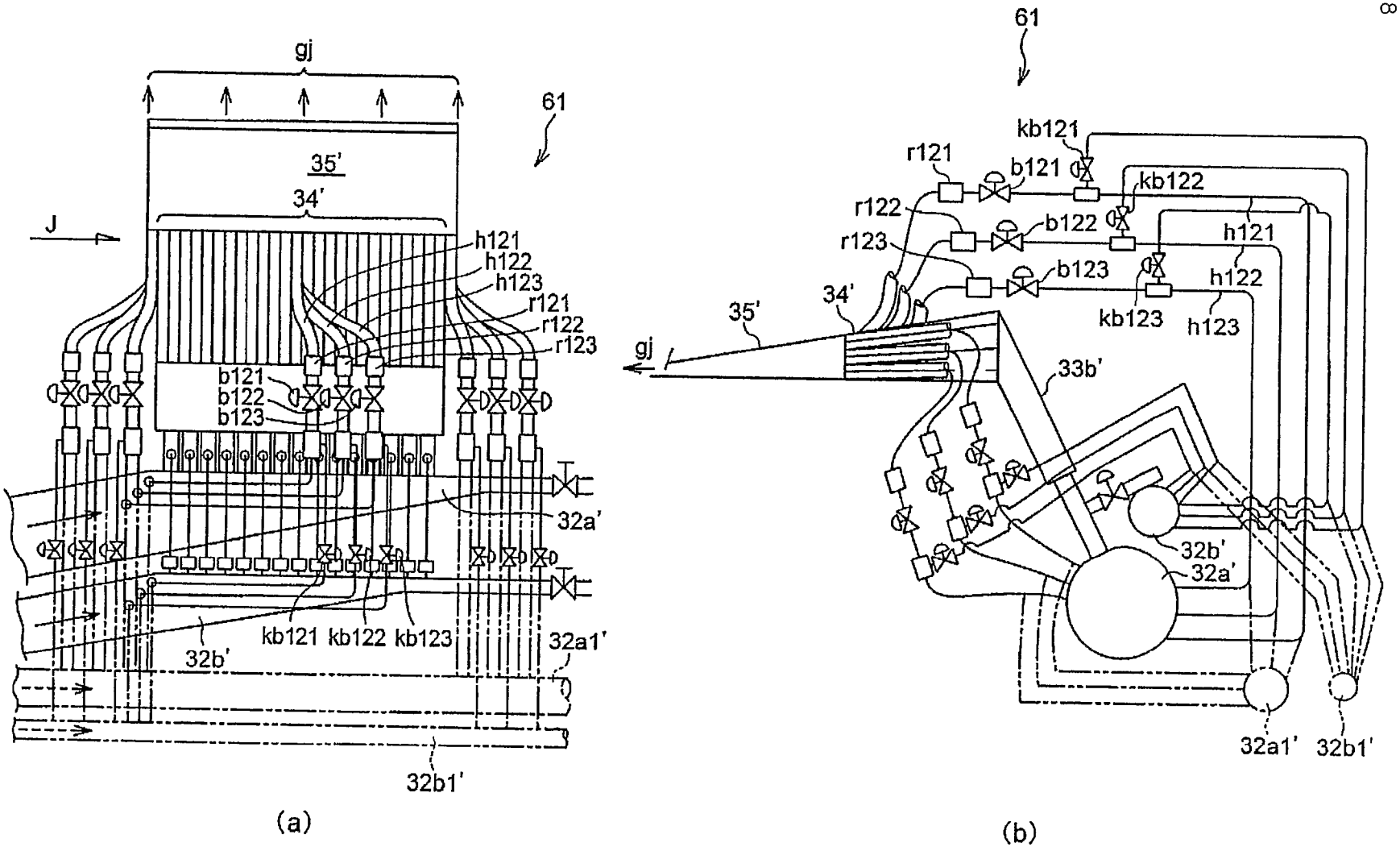
FIGS. 8(*a*) and (*b*) are a schematic top view of a headbox for a concentration controlling type paper machine of a sixth embodiment according to the present invention, and a schematic view seen from the direction of an arrow J, showing the interior of the headbox in FIG. 8(*a*)

In a headbox 61 for a paper machine of the sixth embodiment, as shown in FIG. 8(*a*), which is a schematic top view thereof, and FIG. 8(*b*), which is a schematic view seen from the direction of an arrow J, illustrating the interior of the headbox 61 of FIG. 8(*a*), fiber orientation correction flow pipes (an orientation correcting arrangement) h121, h122, h123 are disposed in a central portion of the turbulence generator 34', connected to the taper header 32*a*', comprise flow control valves b121, b122, b123 and flowmeters r121, r122, r123, and are thus connected to the slice 35'.

The correction flow pipes h121, h122, h123 further comprise flow control valves kb121, kb122, kb123 respectively so as to be connected to the dilution water taper header 32*b*'.

Here, the correction flow pipes h121, h122, h123 in the central portion of the turbulence generator 34' may be provided not only in a single location, but in a plurality of locations other than the two end portions.

According to the configuration described above, the correction flow pipes h121, h122, h123 are provided in a single location in the central portion or also in a plurality of locations other than the two end portions, and hence correction of the fiber orientation of the paper can be performed over the entire width, even in the headbox 1 having a large slice width "m1", by regulating the respective flow rates of the correction flow pipes using the flow control valves so as to vary the flow velocity of the pulp raw material.

Furthermore, the plurality of controllable correction flows overlapping in the direction of paper thickness are disposed at the two end portions and a single location in the central portion or a plurality of locations in addition to the main flow on the inside of the slice 35', and hence the fiber orientation of the pulp fibers can be corrected from the rear surface to the front surface of the paper over the entire width of the slice 35' by varying the respective flow velocities of each correction flow.

As shown by the double-dash line in FIG. 8, the high concentration taper header 32*a*1' for the orientation correction flow only and the dilution water taper header 32*b*1' for the orientation correction flow only are provided separately.

Moreover, the orientation correction flow pipes h121, h122, h123 may be connected only to the correction-only high concentration taper header 32*a*1' and the correction-only dilution water taper header 32*b*1' in order to extract high concentration pulp raw material and dilution water.

According to this configuration, control of the high concentration taper header 32*a*1' for the orientation correction flow only and the dilution water taper header 32*b*1' for the orientation correction flow only can be performed freely and independently of the main flow high concentration taper header 32*a*' and dilution water taper header 32*b*', and hence regulation using the correction flows can be performed in a wider scope.

Incidentally, in the first through sixth embodiments, a fiber orientation sensor is provided for measuring the fiber orientation by causing probes for measuring propagation velocity to contact the manufactured paper appropriately in set regions, releasing ultrasonic waves, and measuring the propagation velocity of the ultrasonic waves.

Alternatively, a fiber orientation sensor is provided for measuring the fiber orientation of the manufactured paper from the reflectance of light which is emitted onto certain regions of the manufactured paper.

By connecting the fiber orientation sensor and the flow control valves and flowmeters of the correction flow pipes to the control system online, open/close control of the flow control valves can be performed automatically on the basis of fiber orientation data obtained by the fiber orientation sensor, data from the flowmeters of the correction flow pipes, and so on, and automatic control can also be performed to maintain the fiber orientation of the paper at a predetermined value.

According to this configuration, a laborsaving paper machine is obtained.

According to the present invention exemplified in the first through sixth embodiments, by correcting the fiber orientation of the paper uniformly over the entire slice width and from the rear surface to the front surface of the paper, extremely high-quality paper can be obtained as an end product and for post-processing such as printing or finishing of the paper.

Moreover, an improvement in operational efficiency can be achieved.

INDUSTRIAL APPLICABILITY

The present invention can be used effectively as a headbox for a paper-making machine, and as a headbox for machines having a similar constitution.

DESCRIPTION OF REFERENCE SYMBOLS

1, 20, 21, 30, 31, 41, 51, 61 headbox
2, 2', 32*a*, 32*a*' taper header
5, 5', 35, 35' slice
2*s*, 2*s*', 32*a*1, 32*b*1, 32*a*1', 32*b*1' correction-only taper header
b1, b2, b3, b21, b22, b23, b31, b32, b33, b41, b42, b43, b5, b6, kb5, kb6, b7, b81, b82, b83, b91, b92, b93, b101, b102, b103, b111, b112, b113, kb101, kb102, kb103, kb111, kb112, kb113, b121, b122, b123, kb121, kb 122, kb123 flow control valve
gi raw material jet
h1, h2, h21, h22, h23, h31, h32, h33, h5, h6, h81, h82, h83, h91, h92, h93, h3, h41, h42, h43, h7, h121, h122, h123 correction flow pipe (an orientation correcting arrangement)
h101, h102, h103, h111, h112, h113 correction flow pipe (another orientation correcting arrangement)
h21, h22, h23, h31, h32, h33, h41, h42, h43, h81, h82, h83, h91, h92, h93, h101, h102, h103, h111, h112, h113, h121, h122, h123 correction flow pipe (paper thickness direction correcting arrangement)
r1, r2, r3, r21, r22, r23, r31, r32, r33, r41, r42, r43, r5, r6, r7, r81, r82, r83, r91, r92, r93, r101, r102, r103, r111, r112, r113, r121, r122, r123 flowmeter

The invention claimed is:

1. A headbox for a paper machine which discharges paper raw material onto a wire as a raw material jet from a slice supplied with the paper raw material, comprising:

an orientation correcting arrangement for correcting a pulp fiber orientation by supplying the paper raw material as a correction flow to a single location in a central portion of the slice; and said correction flow having a same flow direction as a main flow into the slice and being added at a beginning of the slice, wherein the paper raw material is one of extracted from a taper header in which paper raw material for the main flow is stored and extracted from a correction-only taper header in which paper raw material for correcting the pulp fiber orientation is stored.

2. The headbox of claim 1, wherein the orientation correcting arrangement comprises a flow control valve.

3. The headbox of claim 1, further comprising another orientation correcting arrangement for correcting the pulp fiber orientation by supplying the paper raw material as a correction flow to two end portions of the slice.

4. The headbox of claim 3, wherein at least one of said orientation correcting arrangements comprises a plurality of paper thickness direction correcting arrangements overlapping in a direction of paper thickness for correcting the pulp fiber orientation in the paper thickness direction by supplying a correction flow.

5. The headbox of claim 3, wherein at least one of said orientation correcting arrangements comprises a plurality of paper thickness direction correcting arrangements overlapping in a direction of paper thickness for correcting the pulp fiber orientation in the paper thickness direction by supplying a correction flow via flow control valves.

6. The headbox of claim 1, further comprising another orientation correcting arrangement for correcting the pulp fiber orientation by supplying the paper raw material as a correction flow to two end portions of the slice via flow control valves.

7. The headbox of claim 1, wherein said orientation correcting arrangement utilizes concentration-controlled paper raw material.

8. The headbox of claim 1, wherein said orientation correcting arrangement utilizes concentration-controlled paper raw material when said correction flow flows to a location which is to become an end product in a direction of paper width.

9. The headbox of claim 1, wherein said orientation correcting arrangement comprises a flowmeter, a pipe and a flow control valve.

10. The headbox of claim 9, further comprising:

a fiber orientation sensor for measuring the pulp fiber orientation; and a control system for controlling said flow control valve on a basis of pulp fiber orientation data for manufactured paper obtained by said fiber orientation sensor, and data from said flowmeter.

11. The headbox of claim 1, wherein said orientation correcting arrangement comprises a flow pipe, a flow meter, a branch header and a flow control valve.

12. The headbox of claim 1, wherein the correction flow is oriented along the same direction as the main flow at an outlet of a turbulence generator.

13. The headbox of claim 12, wherein the paper raw material is extracted from the taper header in which paper raw material for the main flow is stored.

14. A headbox for a paper machine which discharges paper raw material onto a wire as a raw material jet from a slice supplied with the paper raw material, comprising:

an orientation correcting arrangement for correcting a pulp fiber orientation by supplying the paper raw material as a correction flow to a plurality of locations on the slice that include two end portions thereof; and said correction flow having a same flow direction as a main flow into the slice and being added at a beginning of the slice, wherein the paper raw material is extracted from a correction-only taper header in which paper raw material for correcting the pulp fiber orientation is stored.

15. The headbox of claim 14, wherein the orientation correcting arrangement comprises a flow control valve.

16. The headbox of claim 14, further comprising another orientation correcting arrangement for correcting the pulp fiber orientation by supplying the paper raw material as a correction flow to two end portions of the slice.

17. The headbox of claim 16, wherein at least one of said orientation correcting arrangements comprises a plurality of paper thickness direction correcting arrangements overlapping in a direction of paper thickness for correcting the pulp fiber orientation in the paper thickness direction by supplying a correction flow.

18. The headbox of claim 16, wherein at least one of said orientation correcting arrangements comprises a plurality of paper thickness direction correcting arrangements overlapping in a direction of paper thickness for correcting the pulp fiber orientation in the paper thickness direction by supplying a correction flow via flow control valves.

19. The headbox of claim 14, further comprising another orientation correcting arrangement for correcting the pulp fiber orientation by supplying the paper raw material as a correction flow to two end portions of the slice via flow control valves.

20. The headbox of claim 14, wherein said orientation correcting arrangement utilizes concentration-controlled paper raw material.

21. The headbox of claim 14, wherein said orientation correcting arrangement utilizes concentration-controlled paper raw material when said correction flow flows to a location which is to become an end product in a direction of paper width.

22. The headbox of claim 14, wherein said orientation correcting arrangement comprises a flowmeter, a pipe and a flow control valve.

23. The headbox of claim 22, further comprising:

a fiber orientation sensor for measuring the pulp fiber orientation; and a control system for controlling said flow control valve on a basis of pulp fiber orientation data for manufactured paper obtained by said fiber orientation sensor, and data from said flowmeter.

24. The headbox of claim 14, wherein said orientation correcting arrangement comprises a flow pipe, a flow meter, a branch header and a flow control valve.

25. The headbox of claim 14, wherein the correction flow is oriented along the same direction as the main flow at an outlet of a turbulence generator.

26. The headbox of claim 25, wherein the paper raw material is extracted from the taper header in which paper raw material for the main flow is stored.

* * * * *